United States Patent [19]

Morita

[11] Patent Number: 4,989,299

[45] Date of Patent: Feb. 5, 1991

[54] FASTENER MEANS UTILIZING ATTRACTION OF PERMANENT MAGNET

[76] Inventor: Tamao Morita, 47-1, Arakawa 6 chome, Arakawa ku, Tokyo, Japan

[21] Appl. No.: 435,930

[22] Filed: Nov. 14, 1989

[30] Foreign Application Priority Data

Nov. 15, 1988 [JP] Japan ..... 63-286846

[51] Int. Cl.[5] ..... A44B 21/00; E05C 17/56

[52] U.S. Cl. ..... 24/303; 292/251.5

[58] Field of Search ..... 24/303, 688, 94, 102 FC, 24/49 M; 292/251.5

[56] References Cited

U.S. PATENT DOCUMENTS

| | | | |
|---|---|---|---|
| 2,861,831 | 11/1958 | Loeb | 292/251.5 |
| 2,901,278 | 8/1959 | Robinson | 24/303 |
| 3,159,372 | 12/1964 | McIntosh | 24/303 |
| 3,174,786 | 3/1965 | Wilson | 292/251.5 |
| 4,021,891 | 5/1977 | Morita | 292/251.5 |
| 4,310,188 | 1/1982 | Aoki | 292/251.5 |
| 4,453,294 | 6/1984 | Morita | 24/303 |
| 4,480,361 | 11/1984 | Morita | 292/251.5 |
| 4,700,436 | 10/1987 | Morita | 24/303 |

*Primary Examiner*—Victor N. Sakran
*Attorney, Agent, or Firm*—Pennie & Edmonds

[57] ABSTRACT

A magnetic fastener means, using a simple to manufacture attraction member made up of a permanent magnet with a through hole and a ferromagnetic plate which has a projection that is interference fitted into the through hole, and an attracted member which has a ferromagnetic plate that contacts the attraction member ferromagnetic plate projection when the fastener is closed.

4 Claims, 2 Drawing Sheets

FASTENER MEANS UTILIZING ATTRACTION OF PERMANENT MAGNET

BACKGROUND OF THE INVENTION

1. Field of the Invention

The present invention relates to a fastener means which utilizes the attraction of a permanent magnet and which comprises an attraction member and a member to be attracted. More particularly, in order to converge the magnetism of one of the magnetic poles, a projection made of ferromagnetic material is provided on a plate to be attached on the surface of the magnetic pole. The plate at the magnetic pole and the permanent magnet are firmly fixed by firmly pressing the projection into a hole provided in the direction of the magnetic pole of the permanent magnet to thereby form an attraction member. The member to be attracted is made of ferromagnetic material and is made attachable/detachable with respect to the surface of the other pole of the permanent magnet. By attaching the attraction member and the attracted member to the body and the flap of a handbag respectively, a fastener means is obtained. The fastener means may be attached to a body and a door of a case, or to both ends of a belt or a chain, or on a jacket at the position of a hook or a button, for opening and closing the door, fastening belts, connecting the chain, fastening cloths, etc.

2. Description of the Related Art

Fastener means utilizing the attraction of a permanent magnet are diversified in structure and use.

One of such fastener means is embodied by U.S. Pat. No. 4,021,891. The fastener means according to said invention features a ferromagnetic member which is attached fixedly or detachably to each respective magnetic pole of a magnet, thereby containing the magnetic fields of the poles within the respective plates. At the same time, a hole is provided in the direction of the magnetic pole so that a ferromagnetic projection arranged inside the hole forms a passage of low magnetism connecting the ferromagnetic plates.

As a result, the magnetic flux of the permanent magnet is converged on the ferromagnetic projection in the hole, minimizing the magnetic flux leakage and thus providing a fastener means with firm attraction.

Certain improvements have been made to U.S. Pat. No. 4,021,891 and these are shown in U.S. Design Pat. Nos. 247,467 and 247,468. U.S. Pat. No. 4,453,294 for a fastener means shows an additional improvement U.S. Pat. No. 4,489,361, discloses an additionally improved fastener means with higher shielding effect against magnetic leakage.

In the above mentioned patents, the ferromagnetic plate is attached to one of the magnetic poles either by a non-magnetic case, or by attaching the plate directly to the permanent magnet by an adhesive.

Use of a non-magnetic case as a means to attach the ferromagnetic member for the purpose of converging the magnetic flux is advantageous in that the non-magnetic case covers the outer surface of the magnet and, therefore, both protects the magnet against damage and offers a better appearance. However, the presence of the non-magnetic case causes a magnetic gap between the surface of the attraction member and the member to be attracted, equivalent to the thickness of the case. This prevents the magnetic flux of the attraction member from effectively reaching the member to be attached and causes flux leakage of the flux outside the fastener means.

Manufacturing difficulty is a second problem of the above mentioned means. The non-magnetic case is usually manufactured by press-holding. Thereafter, it is necessary to fix the permanent magnet and ferromagnetic plate within the case. This involves the handling of the several components, as well as troublesome assembling steps, and leads to a high cost for the final product.

In order to overcome both the magnetic gap and the production cost problems, one possible solution is to directly attach a ferromagnetic member to one of the magnetic poles of a permanent magnet with an adhesive. This eliminates the magnetic gap that is formed by a non-magnetic case, thereby improving the attraction between the magnet and the member to be attracted. However, in order to fabricate a fastener of this type, it is necessary to apply an adhesive, align the positions of a permanent magnet and the ferromagnetic plate, press the two members together in a manner that does not cause the adhesive to be squeezed out, and maintain the pressure between the two members until the adhesive is completely set. Once again, because of the numerous productions steps, the production cost becomes high. Furthermore, there is no ready method to check the condition of adhesion between the permanent magnet and the ferromagnetic plate, which results in a danger that the adhesion between the two members may be or may become ineffective and ultimately result in the parts separating from each other by subsequent impact.

Another fastener means, such as that disclosed in U.S. Pat. No. 4,700,436, includes a permanent magnet made of synthetic resin, utilizes a unique design wherein the ferromagnetic member is integrally buried inside the magnet. As a result, there is no need to attach the ferromagnetic member to one of the magnetic poles of the magnet. Nor is it necessary to attach the ferromagnetic member by means of a non-magnetic case. As a result, the problems encountered in the construction and/or manufacture of the prior art fastener means were solved.

However, the fastener means mentioned above has serious drawbacks. In particular, since the permanent magnet is made from synthetic resin by injection-molding extreme care must be exercised in incorporating the ferromagnetic member inside the resin. The procedure requires the use of a high degree of skill in carrying out a number of troublesome steps. Furthermore, the ferromagnetic member incorporated inside the magnet is likely to be at an undesired angle, making it difficult to establish firm attraction between the attraction member and the member to be attracted.

OBJECT AND SUMMARY OF THE INVENTION

A main object of the invention is to assemble the permanent magnet and the ferromagnetic member without using a non-magnetic case or an adhesive and thereby provide an inexpensive fastener means by reducing the assembling cost.

Another object of the invention is to provide a fastener means in which the components constituting the attraction member are firmly and accurately fixed to one another.

Still another object of the invention is to provide a fastener means which does not have a magnetic gap between the contact surface of the attraction member and the member to be attracted, so that a more effective attraction is achieved between the two members.

Still another object to the invention is to provide a fastener means in which the attraction member includes a ferromagnetic projection which snugly fits in the hole of a permanent magnetic member in such a manner that magnetic flux leakage can be minimized even when the attraction member is not engaged with the member to be attracted.

These and other objects of the present invention will become more apparent from the following description and the scope of the patent claims.

The attached drawings show various embodiments of the present invention to explain the invention in concrete terms.

BRIEF DESCRIPTION OF THE DRAWINGS

FIG. 5 is a sectional view to show the most typical example of use.

FIG. 6 is a sectional view of still another embodiment.

FIG. 7 and 8 show the components of still another embodiment in an exploded perspective view and a sectional view when assembled respectively.

FIG. 9 is a sectional view to show still another assembled embodiment.

FIG. 10 is a sectional view of assembled components to show t improvement of the embodiment shown in FIG. 9.

FIG. 11 shows a fastener in section in which the attraction member is fabricated using an adhesive. FIG. 12 is a sectional view of a fastener means wherein a non-magnetic case is used.

DESCRIPTION OF THE PREFERRED EMBODIMENTS

Figure 1:
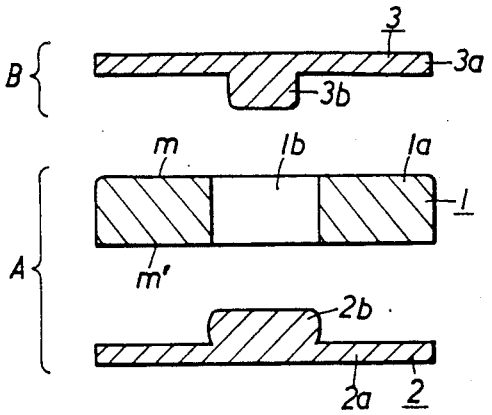
FIG. 1 is a sectional view illustrating the components making up a fastener.
Figure 2:
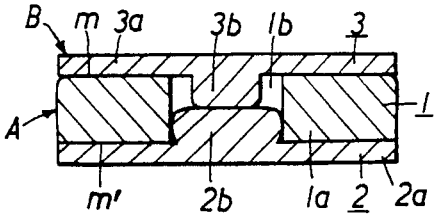
FIG. 2 is a sectional view showing the fastener components after assembly.
Figure 3:
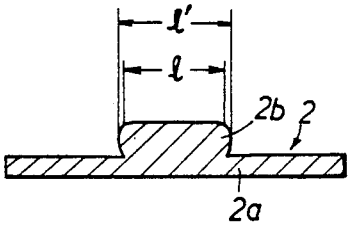
FIG. 3 is a sectional view of a ferromagnetic member which constitutes the attraction member of the new fastener means.

Referring first to the fastener means shown in FIGS. 1–3, the fastener means comprises an attraction member A and a member B to be attracted. The attraction member A comprises a permanent magnet 1 having an annular plate 1*a* and a hole 1*b* extending between magnetic poles m and m′ and a ferromagnetic member 2 is shown With a plate 2*a* in contact with the pole m′ with a projection 2*b* pressed in the hole 1*b*. The projection 2*b* has a height which reaches substantially the mid portion of the hole 1*b*.

As the projection 2*b* of the ferromagnetic member 2 is firmly pressed into the hole 1*b* of the magnet 1, the ferromagnetic plate 2 and the permanent magnet 1 are engaged firmly with each other.

As for the engagement between the ferromagnetic member 2 and the permanent magnet 1, the diameter 1 of the projection 2*b* is made smaller than the diameter 1′, which is, in turn, slightly larger than the hole 1*b* diameter, and, as a result, the projection 2*b* can be easily inserted in the hole 1*b* and yet snugly fitted therein.

Moreover, because of the barrel-shape of the projection 2*b* with its mid-portion bulging, the engagement of the projection with the hole 1*b* becomes more secure, and there is no chance for the projection 2*b* to slip out of the hole 1*b* once it is pressed into the hole.

With the outer periphery of the projection 2*b* pressed into the hole 1*b* good contact between the projection and the inner periphery of the hole 1*b* is achieved, and the converging of magnetic flux of the pole m on the projection 2*b* is assured. Even when the ferromagnetic member 3 is not in the attracted position shown in FIG. 2, there will be little leakage of flux to the outside of attraction member A. As a result, there is a reduced chance of any inconveniences caused by leaked flux, such as the destruction of magnetically recorded data on a magnetic card or cassette.

As a counterpart of the attraction member A of the above construction, the member B to be attracted comprises a ferromagnetic member 3 having a plate 3*a* which is in contact with the pole m of the magnet 1 and a projection 3*b* which comes in contact with said projection 2*b* inside said hole 1*b*.

The projection 3*b* of the ferromagnetic member 3 preferably has a height such that the top of the projection 3*b* abuts against the top of the projection 2*b* in the hole 1*b* when the plate 3*a* comes in contact with the pole m of the attraction member A.

FIG. 2 shows the engagement of the attraction member A with the attracted member B of the above constructions. The magnetic flux of the permanent magnet 1 will not leak outside as there is no gap between the pole m and the plate 3*a* or between the pole m′ and the plate 2*a* that would otherwise cause a magnetic reluctance.

As a result, the magnetic flux will pass through a magnetic circuit formed by the pole m, plate 3A, projection 3*b*, projection 2*b*, plate 2*a* and pole m′, producing an intensive attraction between the projections 2*b* and 3*b*.

The ferromagnetic member used in the present specification can be made from various materials with high permittivity such as pure iron generally identified as electromagnetic soft-iron, carbon steel containing 0.03–1.7 percent carbon, and alloys of iron and nickel called Permalloy. The ferromagnetic member may, therefore, be called a soft magnetic material.

The permanent magnet material used in the present specification includes KS steel, MK steel, magnetic material sintered with rare-earth elements, and synthetic resin.

The synthetic resin permanent magnet is obtained by molding a synthetic resin which is mixed with a powder of hard magnetic material such as ferrite powder. An example is a mixture of 87 wt percent of ferrite powder and 13 wt percent of 6-nylon.

The permanent magnet to be used in the present invention may be any permanent magnet which has an annular plate 1*a* that can withstand the impact caused by the press fitting of the projection 2*b*. The permanent magnet made of synthetic resin is particularly preferable as it is softer and more resistant to tensile strain than other types of permanent magnet.

The permanent magnet consisting of 13 wt percent of 6-nylon and 87 wt percent of ferrite powder has the Rockwell hardness of 122 and tensile strength of 147 kg/cm$^2$, and is, therefore, particularly suited for press fitting of the projection 2*b* into magnet 1.

The projection 2*b* may also be of any structure which can be firmly pressed into engagement with the inside of hole 1*b* and will not slip out. The projection 2*b*, therefore, need not be barrel-shaped with its midportion bulging. However, the barrel-shaped projection 2*b* is more advantageous in that it fits in the hole 1*b* more firmly and ideally, compared with projections which do not bulge but are more linear in contour. In addition, the barrel-shaped projection can be easily press-molded.

In one embodiment, the projection 2*b* was made with a diameter 1' of 6.25–6.3 mm and was forcibly pressed into a 1*b* hole having a diameter of 6.2 mm. In this embodiment, the two members were completely engaged with each other and the projection 2*b* could not be readily pulled out of the hole 1*b*.

Further, the projection 2*b* may be of any shape or structure so long as it achieves the objectives mentioned above. The plate 2*b* and the projection 2*b* may be formed as separate and individual parts and then integrally assembled by welding or caulking to form a ferromagnetic member 2.

The same applies to the ferromagnetic member 3. The projection 3*b* of the ferromagnetic member 3 may be of any structure or size so long as it is thick enough to allow a magnetic passage of the magnetic flux. It can be as thin as possible so long as the above condition is satisfied. When the projection 3*b* is relatively thin with respect to the hole 1*b*, engagement and removal of the projection 3*b* to and from the hole 1*b* is facilitated.

Figure 4:
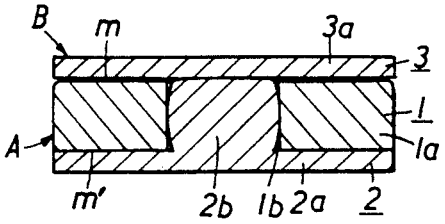
FIG. 4 is a sectional view that illustrates an alternative embodiment of the invention from the one shown in FIGS. 1–3.

In the fastener means shown in FIG. 4, the member B, which is to be attracted, has no projection 3*b*, and the attraction member A has a projection 2*b* which comes in direct contact with the surface of the plate 3*a* of the ferromagnetic member 3. Accordingly, the projection 2*b* is firmly pressed inside the hole 1*b* of the magnet 1 and projects slightly beyond the upper edge of the hole 1*b* in the magnet 1. The top portion of the projection 2*b* that projects slightly out of the hole 1*b* is caused to come in contact with the ferromagnetic member 3 of the member B to be attracted, whereby a magnetic circuit is formed.

Moreover, as the projection 2*b* is pressed into the hole 1*b* along its entire depth, the engagement between the ferromagnetic member 2 and the magnet 1 becomes more firm and secure.

By causing the projection 2*b* to slightly project above the hole 1*b*, there will be formed a magnetic circuit with low magnetic reluctance which passes through the projection 2*b*. At the same time, the small interval or gap between the plate 3*a* of the ferromagnetic member 3 and the pole m of the permanent magnet 1 prevents irregularities, if any, on the surface of the magnetic pole m from affecting the magnetic circuit formed through the projection 2*b*.

One alternative to the embodiment illustrated in FIG. 4 is that the top surface of the projection 2*b* may be made flush with the upper peripheral edge of the hole 1*b*, so as to be on the same plane as the face of the magnetic pole m.

As another alternative, the top of the projection 2*b* may be slightly indented from the periphery of the hole 1*b*, so that there will be formed a small interval between it and the ferromagnetic member 3 in contact with the pole m. Even in this case, no degradation will occur in the magnetic circuit passing the projection 2*b* since the interval between the projection 2*b* since the interval between the projection 2*b* at its top and the ferromagnetic member 3 is minimal.

Since the projection 2*b* of the ferromagnetic member 2 in the attraction member A described above is provided very near the magnetic pole m of the magnet 1, the magnetic flux of the pole m will converge on the projection 2*b*. This construction provides the added advantage of minimizing the amount of magnetic flux that can be leaked outside the attraction member A even when the ferromagnetic member 3 is out of magnetic engagement.

It should be understood that the component parts and the structures of the embodiments shown in FIGS. 4–10 are essentially identical with those shown in FIG. 1–3. Thus, a detailed description of the parts which are common for all of these embodiments will be omitted in the following description.

Embodiments shown in FIGS. 5–10 are modifications of the embodiment shown in FIGS. 1–4 and have different attachment means adapted to specific uses.

Figure 5:
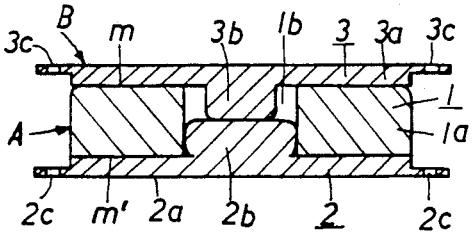
FIGS. 5–10 show typical practical uses of the fastener means shown in FIGS. 1–4.

In the embodiment shown in FIG. 5, the ferromagnetic member 2 and the permanent magnet 1 are so assembled that the peripheral edge of the plate 2*a* of the ferromagnetic member 2 projects beyond the magnet 1. The peripheral edge of the plate 3*a* of the ferromagnetic member 3 in the corresponding member B to be attracted is made to project beyond the plane of the magnetic pole m. A small hole, 2*c* and 3*c*, is provided on the periphery of the plates 2*a* and 3*a* respectively.

The attraction member A and the member B to be attracted having respective small holes 2*c* and 3*c* may be attached to a cabinet and the like by means of a nail, screw, etc. to form a fastener means. Also the members may be attached to handbags, clothings, bag luggages and the like by means of rivets or by sewing.

In this embodiment, as with the embodiment shown in FIG. 4, the projection 3*b* of the member B to be attracted may be omitted, and the projection 2*b* of the attraction member A may be formed to extend to the periphery of the hole 1*b* of the magnet 1.

Figure 6:
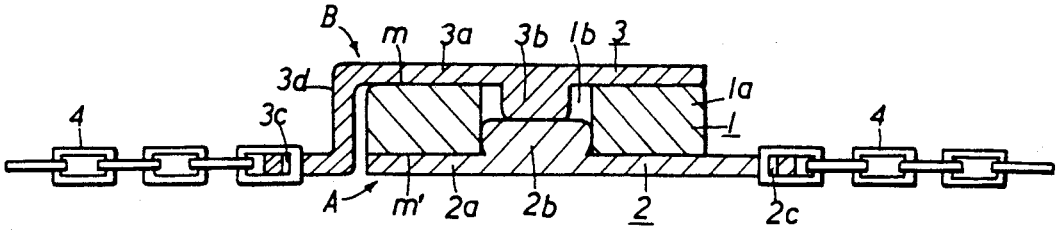

In the fastener shown in FIG. 6, the projection 2*b* is forcibly pressed inside the hole 1*b* of the magnet 1. A portion of the plate 2*b* of the ferromagnetic plate 2 tightly fixed to the magnet 1 is made to project sideways beyond the magnet 1, where a small hole 2*c* is provided for attaching a chain 4 or the like. A L-shaped attachment plate 3*d* extends from the plate 3*a* of the ferromagnetic member 3 in the member B to be attracted. A small 3*c* is provided on the plate 3*d* for attaching a chain 4, etc.

This embodiment is applicable to necklaces, bracelets, etc., as well as to belts and the like in place of a buckle. In fact, it is applicable to provide fastening means for all types of strings, chains, bands, belts, etc.

Further with this embodiment, it is possible to omit the projection 3*b* of the member B, as in the embodiment shown in FIG. 4, and the projection 2*b* of the member A may be extended to reach the upper periphery of the hole 1*b* of the magnet 1. In this case, the plate 3*a* is preferably provided with a member to act as a stopper opposite the plate 3*d*.

Figure 7:
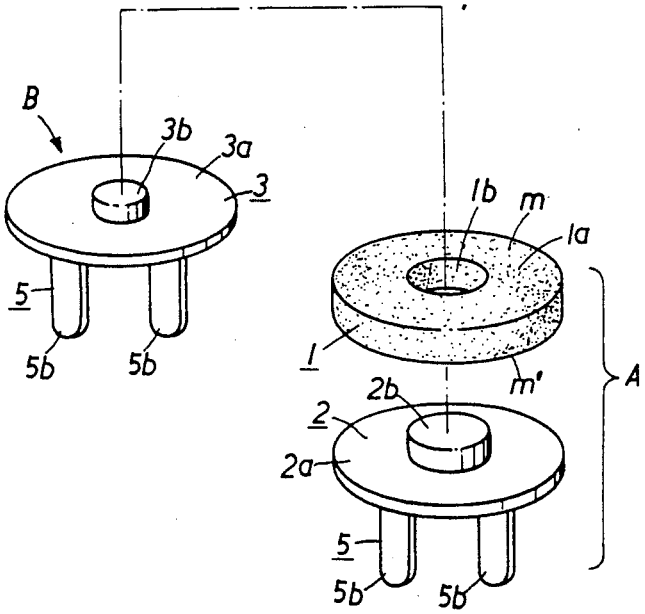
Figure 8:
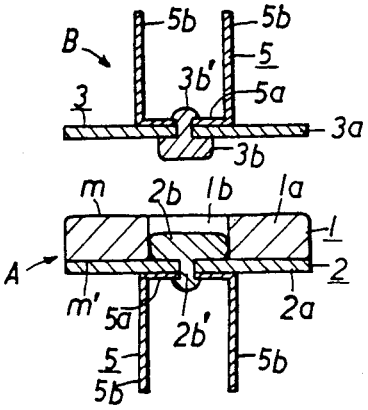

The attraction member A and the member B to be attracted of the embodiment shown in FIGS. 7 and 8 are each provided with a leg 5 for attachment purposes. The leg 5 is pierced into the body of a handbag, other luggages and bags, belts, cloths, cases and the like and the tip thereof is bent for secure attachment.

A typical leg 5 comprises a seat 5*a*, and leg members 5*b*, 5*b* provided on both sides of the seat 5*a* at a normal angle. It may be of any shape or structure so long as the intended function is achieved.

In the above embodiment, the ferromagnetic members 2 and 3 comprise plates 2*a*, 3*a* and projections 2*b*, 3*b* respectively. The projections 2*b* and 3*b* are provided with smaller diameter rods 2*b*', 3*b*'. An opening is provided on the plates 2*b*, 3*b* to receive respective rods 2*b*', 3*b*'. By crushing the rods 2*b*', 3*b*l' of the projection 2*b*, 3*b* inserted in the hole, the projections 2*b*, 3*b* and the rods 2*b*', 3*b* ' are integrally attached with each other.

By separating the ferromagnetic members 2, 3 into two different components, consisting of plates 2*a* and 3*a* and projections 2*b* and 3*b* respectively, the press-molding of the plates 2*a* and 3*a* is facilitated, since it only requires punching out from a flat plate. It is also advantageous in that the projections 2*b* and 3*b* may be molded using a small press machine. Moreover, when rods 2*b*' and 3*b* ' with a smaller diameter are provided on the projections 2*b* and 3*b*, the rods 2*b*' and 3*b*' may be inserted in the holes of the plates 2*a* and 3*a* and the seats 5*a* and 5*b* of the legs 5 respectively. The rods 2*b*'and 3*b*' thus inserted may be crushed on the surface of the seats 5*a* and 5*b* to integrally assemble and fix the plates 2*a* and 3*a* with the projections 2*b* and 3*b* and the legs 5.

By forcibly pressing the projection 2*b* of the ferromagnetic member 2 into the hole 1*b* of the permanent magnet 1, the attraction member A is assembled. The member B to be attracted comprising the ferromagnetic member 3 of the above construction is attracted by the member A.

Figure 9:
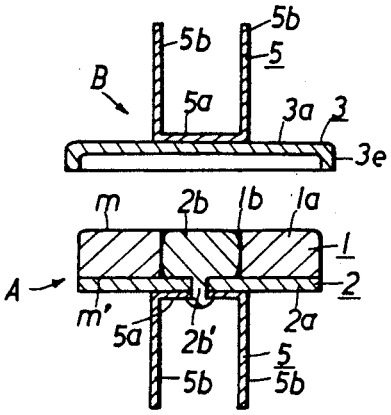
Figure 10:
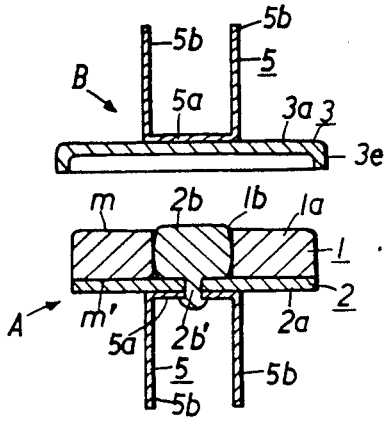

In the embodiment shown in FIG. 9, the projection 2*b* of the ferromagnetic member 2, which is the attraction of member A, has a height that reaches the outer periphery of the hole 1*b* of the magnet 1. The corresponding ferromagnetic member 3 of the member B to be attracted has a raised flange 3*e* on the periphery of the plate 3*a* in contact with the magnetic pole m, to form a generally shallow dish. As a result, the ferromagnetic member 3 attracted by the magnetic pole m will be prevented from sliding over the surface of the pole m to be dislocated but will remain stably attracted. In the embodiment shown in FIG. 10, the projection 2*b* of the ferromagnetic member 2 which is the attraction member A extends slightly outward from the periphery of the hole 1*b* of the magnet 1. This allows the attraction member A and the member B to be in solid and stable contact with each other, even if the magnetic pole m of the magnet 1 has an irregular surface.

Figure 11:
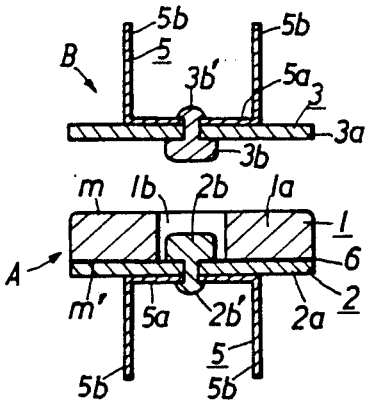
FIG. 11 PRIOR ART
FIGS. 11 and 12 show comparative embodiments.
Figure 12:
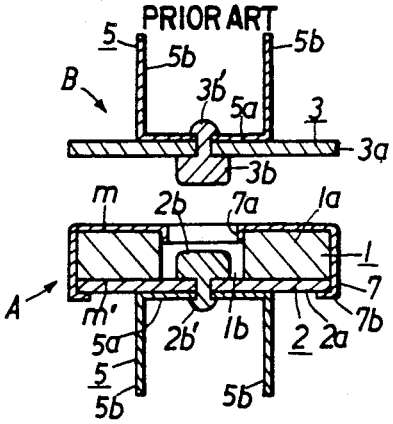
FIG. 12 PRIOR ART

The fasteners shown in FIGS. 11 and 12 are conventional prior art fastener means and are shown as comparative embodiments for illustration purposes. A detailed description of components and structure that are identical with those of the embodiments described above is not felt to be necessary. In the fastener shown in FIG. 11, the ferromagnetic member 3 includes the plate 2*a* and the leg 5 that are integrally attached by means of the projection 2*b*. The plate 2*a* is attached to the magnetic pole m' of the permanent magnet 1 using an adhesive 6, to thereby construct the attraction member A. The projection 2*b* of the ferromagnetic plate 2 is, therefore, shown to be merely projected into the hole 1*b* of the magnet 1 with a large surrounding annular air gap. This contrasts with the projection 2*b*, as shown in Figs. 1'10 of the present invention, which is constructed to be in close contact with the inner wall of the hole 1*b*. This comparative prior art fastener means was observed to have disadvantages which accompany the use of adhesive as mentioned earlier.

In the comparative fastener shown in FIG. 12, the ferromagnetic member 2, which is formed by the same method as in the fastener means shown in FIG. 11, is attached to the magnetic pole m' of the magnet 1 using a non-magnetic case 7. The case 7 is shaped as a deep dish so that the magnet 1 can be contained entirely therein. A hole is provided at its bottom to communicate with the hole 1*b* of the magnet 1. The edge of the hole is bent inward to form a flange 7*a*. The magnet 1 is placed inside said case 7, and the clicks 7*b* provided on the free end of the case 7 are bent toward the surface of the plate 2*a* of the ferromagnetic member 2 which is held in contact with the magnetic pole m'. In this manner, the magnet and the ferromagnetic plate 2 are fixed inside the case 7.

This comparative fastener means was observed to have disadvantages which accompany the use of a non-magnetic case as mentioned earlier.

The attraction member of the fastener means according to the present invention is simple to assemble and yet, does not require use of an adhesive or a non-magnetic case. Disadvantages caused during assembling due to the use of adhesive or structural and functional inconveniences of the assembled attraction member can be avoided. Similarly, disadvantages and inconveniences caused by the use of a non-magnetic case can also be avoided.

The present invention, therefore, provides an inexpensive fastener means with excellent attraction force. The present invention is applicable not only to relatively large size fasteners but is also particularly suitable in providing small size fasteners. Fastener means according to the present invention are applicable to all types of uses.

The present invention is specifically intended to include the objects described above and the fasteners which are preferable in achieving the objects. It is also intended to include fasteners that can be obtained by modifying the present invention by the use of known technical measures to achieve the disclosed results.

What is claimed is:

1. A fastener means utilizing the magnetic attraction of a permanent magnet, which provides an improved magnetic circuit so as to minimize magnetic flux leakage and increase magnetic attraction, comprising:

a member to be attracted which includes a plate made of a ferromagnetic material;

an attraction member which includes a permanent magnet with a through hole in line with its magnetic pole and a ferromagnetic plate with a projection, wherein said attraction member is constructed by forcibly inserting said projection on the ferromagnetic plate in the hole of the magnet in such a manner that the principal surface of the ferromagnetic attractor plate come in close contact with one of the magnetic poles of the magnet to thereby firmly fix the projection inside the hole of the magnet, and that said attracted member's ferromagnetic plate is attracted by and contacts the other magnetic pole of the permanent magnet of said attraction member and contacts said projection erected inside said hole of the said permanent magnet.

2. The fastener means utilizing the magnetic attraction of a permanent magnet as claimed in claim 1 wherein the projection of the ferromagnetic member which is forcibly inserted into the hole of the permanent magnet is barrel-shaped with its top portion and the base portion being smaller in diameter.

3. A fastener means utilizing the magnetic attraction of a permanent magnet which provides an improved magnetic circuit so as to minimize magnetic flux leakage and increase magnetic attraction comprising:

a permanent magnet having sides of opposite polarity and a through hole between said sides;

a member to be attracted which includes a first plate made of a ferromagnetic material and having a first ferromagnetic rood extending into said hole, such that said first plate is in close contact with one of said polarized sides of said magnet;

a second plate made of ferromagnetic material and having a ferromagnetic rod of wider diameter than the diameter of the hole in said magnet, said second rod being forcibly inserted into the hole of said magnet such that said second ferromagnetic plate comes in close contact with the side of said magnet of opposite polarity, and said second rod contacts the end of said first rod in said hole, whereby said first and second plates are in close contact with the other oppositely polarized side of said magnet and said rods are in contact with each other inside said hole to minimize magnetic flux leakage and increase the magnetic attraction between the member to be attracted and said magnet.

4. The fastener means utilizing the magnetic attraction of a permanent magnet as claimed in claim 3 wherein the second rod of said second plate which is forcibly inserted into the hole of the permanent magnet is barrel-shaped with its top portion and the base portion being smaller in diameter.

* * * * *